US006860730B2

(12) United States Patent
Leppanen

(10) Patent No.: US 6,860,730 B2
(45) Date of Patent: Mar. 1, 2005

(54) METHODS AND APPARATUS FOR UNLOADING A SCREW COMPRESSOR

(75) Inventor: Jarmo Leppanen, Gainesville, FL (US)

(73) Assignee: Driltech Mission, LLC, Alachua, FL (US)

( * ) Notice: Subject to any disclaimer, the term of this patent is extended or adjusted under 35 U.S.C. 154(b) by 0 days.

(21) Appl. No.: 10/147,883

(22) Filed: May 20, 2002

(65) Prior Publication Data

US 2003/0215338 A1 Nov. 20, 2003

(51) Int. Cl.[7] ..... F04C 18/16; F04C 29/02; F04B 49/02

(52) U.S. Cl. ..... 418/201.2; 418/1; 418/97; 417/440

(58) Field of Search ..... 418/1, 9, 15, 97, 418/201.2; 417/440

(56) References Cited

U.S. PATENT DOCUMENTS 3,708,024 A 1/1973 Back
3,947,078 A 3/1976 Olsaker
4,549,856 A * 10/1985 Cash et al. ..... 417/295
RE32,055 E 12/1985 Schibbye et al.

FOREIGN PATENT DOCUMENTS

JP 57-99291 * 6/1982 ..... 417/440

* cited by examiner

*Primary Examiner*—John J. Vrablik
(74) *Attorney, Agent, or Firm*—Burns, Doane, Swecker & Mathis, L.L.P.

(57) ABSTRACT

A screw compressor is connected to a motor to be driven by the motor even during periods of low compressed air consumption. During such periods, the screw compressor is at least partially unloaded to make it easier and less costly to drive the compressor. The unloading is performed by removing air from the compressor. Preferably, that is done by communicating the air inlet of a small capacity vacuum device with the air outlet of the screw compressor. Suction from the vacuum device is transmitted to the air outlet of the screw compressor to suck air out of the screw compressor to reduce the engine horsepower needed to rotate the screw compressor. The vacuum device can also be used to boost the air volume and/or the air pressure. The system can be used in a drilling rig which drills holes in the ground. The screw compressor can be unloaded during start up of the motor by briefly driving the vacuum device by pressurized liquid from a pre-pressurized hydraulic accumulator.

12 Claims, 5 Drawing Sheets

METHODS AND APPARATUS FOR UNLOADING A SCREW COMPRESSOR

BACKGROUND OF THE INVENTION

The present invention relates to air compression systems, in particular to such systems employing a screw compressor driven by a motor such as a diesel engine or an electric motor, which also drives other equipment, and which continues to drive such equipment as well as the screw compressor even during periods of low compressed air consumption.

Motor-driven screw compressors provide a source of compressed air that performs many useful functions. Screw compressor systems have gained acceptance and significant growth due to their robustness, compactness and reliability. Designed for long periods (normally over 100,000 hours) of continuous operation, they provide up to 98% online availability. Their low maintenance costs together with their high energy efficiency minimizes operating costs. The smooth running action of the rotors enables screw compressors to handle the most difficult gases, contaminants, or liquid slugs without vibration.

Among the many examples of machines which use screw compressors are drilling rigs wherein a drill bit of a drill string is rotated to drill a hole in the ground, i.e., in earth and/or rock. In order to flush the cuttings from the hole as it is being drilled, it is common to employ a screw compressor to produce pressurized air which is conducted downwardly through the drill string to the front face of the drill bit. The cuttings become entrained in the airflow and are brought to the surface as the air travels upwardly along the exterior of the drill string. The pressurized air also serves to cool the cutting elements of the drill bit.

In the case of so-called percussive tools, the pressurized air also functions to reciprocate an impact piston which applies percussive blows from a piston to a rotating drill bit to enhance the cutting action. The piston is disposed below the ground surface immediately above the drill bit (i.e., a so-called down-the-hole hammer).

In many compressed air applications it is common to drive the screw compressor by a motor (i.e., a fuel-driven engine or an electrically driven motor), which also drives other equipment, such as a hydraulic system which functions to: power hydraulic motors to raise and lower the drill string, add drill rods to the drill string as drilling progresses, remove drill rods from the drill string as the drill string is being withdrawn from the hole, raise and lower a drilling mast, raise and lower leveling jacks, and propel the drilling rig (in the case of a mobile drilling rig). The motor also drives a hydraulic pump and a cooling fan of a cooling system.

The compressed air needs of such a drilling machine are associated with the supplying of flushing air for flushing cuttings and/or driving the impact piston of a percussive tool. Thus, for long periods during operation of the drilling rig, there is no need for pressurized air, such as during the adding or removal of drill rods, relocating the drill rig, setting up the drill rig, lunch breaks etc. Although there is no need during those periods to circulate compressed air to flush cuttings or to reciprocate the impact piston, it is still necessary to drive the motor in order to power the hydraulics.

In a typical air compressing system, the drive connection between the screw compressor and the motor is such that the screw compressor is driven whenever the motor is driven, despite the fact that continuous operation of the screw compressor is not necessary when drilling is not taking place. In an effort to reduce the wasted energy consumption of the motor in such a case, the air inlet of the screw compressor is closed, but that results in a reduction of perhaps only 25% of the energy required to drive the screw compressor, because even with its inlet closed, the screw compressor is still compressing air at its outlet, i.e., air trapped between the compressor outlet and a compressed air reservoir to which the outlet is usually connected.

There are certain measures that could be taken to further reduce the unnecessary consumption of energy. For example, a clutch could be provided between the engine and the screw compressor to unload the compressor during periods of low air requirements, but that would add considerable cost to the equipment, and the clutch would rapidly wear in situations where the compressor has to be unloaded frequently. It is uneconomical and impractical to switch the compressor on and off at frequent intervals. In that regard, even during periods where a large quantity of compressed air is not needed, smaller quantities may still be needed, whereupon the screw compressor may have to cycle on and off to keep the air reservoir sufficiently pressurized.

Another possible energy-saving measure involves the provision of a variable speed gear drive for unloading the screw compressor, but such a drive is complicated and relatively expensive, as would be a two-speed gear drive with clutches. With a variable speed gear drive, the rpm on the compressor could be reduced for reduced energy consumption.

A relatively low-cost possible measure involves driving the screw compressor with a hydraulic motor that can be easily stopped or slowed during periods of low pressure requirements. However, such drives are relatively inefficient (80% maximum), so any energy savings realized during periods of low compressed air consumption would be lost during periods of high air compressed consumption.

Therefore, it would be desirable to provide an air compressing system employing a motor-driven screw compressor which, despite being driven by the motor during periods of low air compressed consumption, minimizes power consumption in a relatively inexpensive, yet simple and reliable way.

SUMMARY OF THE INVENTION

The present invention relates to a screw compressor unloading system comprising a screw compressor which includes an air inlet and an air outlet. An intake valve is provided for closing the air inlet. A vacuum device is provided which is of substantially smaller maximum capacity than the screw compressor. The vacuum device has an air inlet and an air outlet. The air inlet of the vacuum device is communicable with the air outlet of the screw compressor to enable the vacuum device to unload the screw compressor by substantially equalizing respective pressures at the air inlet and the air outlet of the screw compressor when the air inlet valve is closed.

The invention also pertains to a method of at least partially unloading the screw compressor by removing air therefrom as the screw compressor is being driven with its air inlet closed. Preferably the unloading is accomplished using the vacuum device.

The method and apparatus can be used to unload a screw compressor to facilitate the start-up of a motor that drives the screw compressor, or economize the operation of the motor as it drives the screw compressor during periods when the need for compressed air is low.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figure 1:
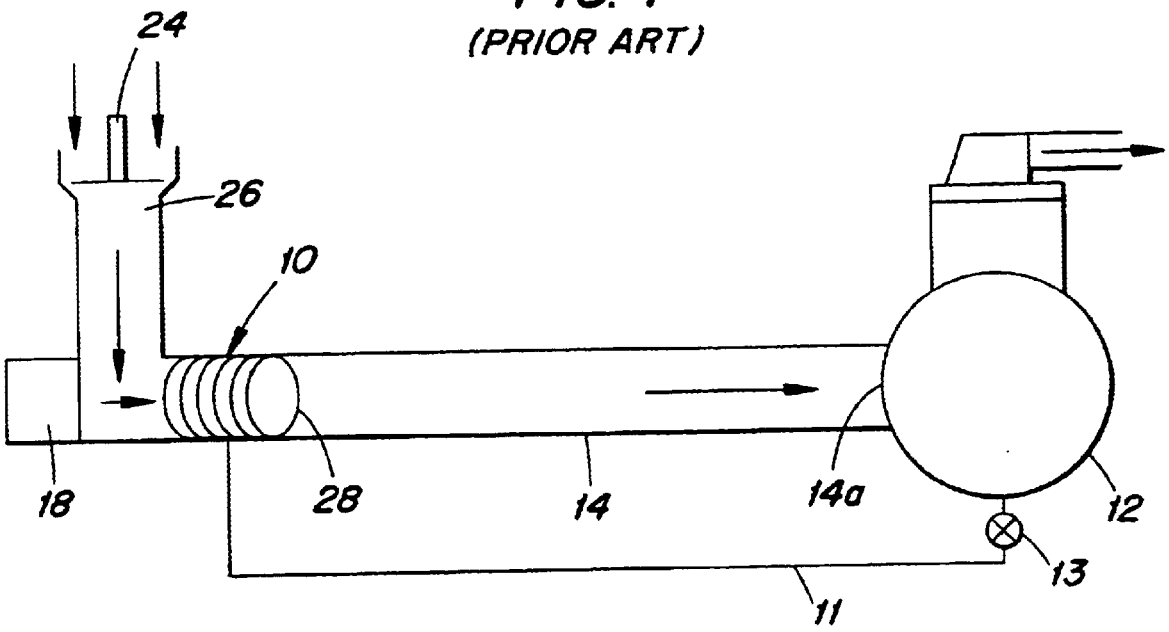
FIG. 1 (PRIOR ART)
FIG. 1 is a schematic view of a conventional air compressing system utilizing a screw compressor.

Depicted in FIG. 1 is a conventional air compressing system in which air is compressed by a screw compressor 10, the compressed air being conducted through a main air discharge passage 14 having a discharge outlet 14*a* connected to an inlet of the air reservoir 12. The air reservoir 12 stores compressed air and contains lubricating oil that is supplied to the main screw compressor 10 by way of a conduit 11 to lubricate, seal and cool the main screw compressor. The oil is injected into the main screw compressor due to a pressure difference between the air reservoir and the main screw compressor. Alternatively a pump (not shown) could be provided for injecting the oil into the main screw compressor. A valve 13 is provided for closing the conduit 11 when the motor 18 and the main screw compressor 10 have been shut down.

Figure 2:
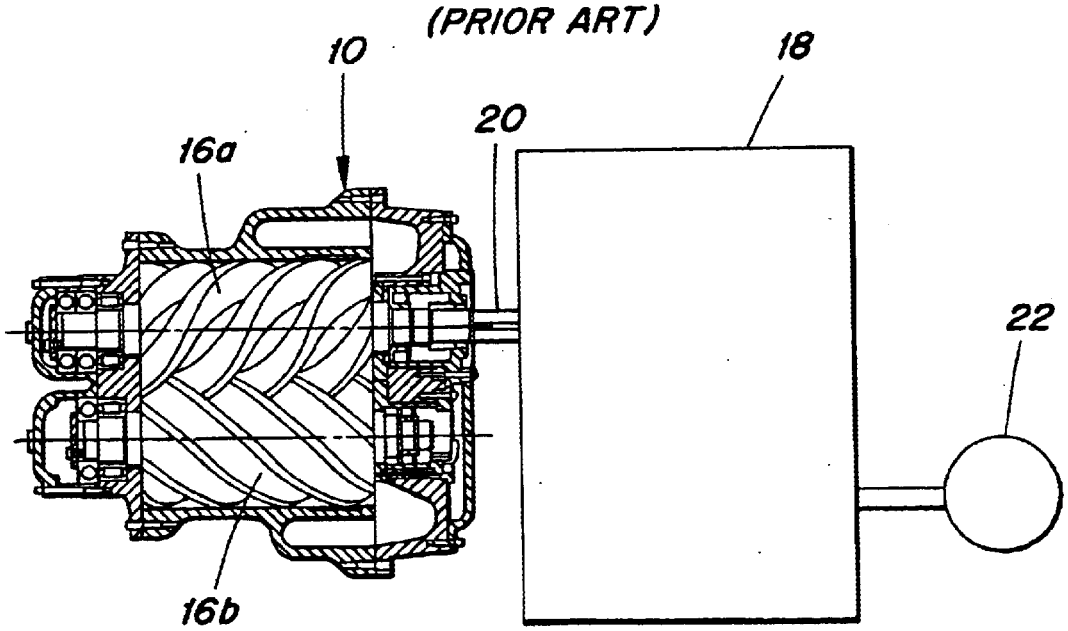
FIG. 2 (PRIOR ART)
FIG. 2 is a schematic view of a conventional screw compressor being driven by a motor with the screw compressor being shown in cross section.

The main screw compressor 10 preferably employs a pair of intermeshing screws 16*a*, 16*b* as shown in FIG. 2. The screws are driven by a motor 18 through a suitable drive coupling 20.

The coupling 20 between the motor 18 and the main screw compressor 10 is characterized in that the compressor 10 is driven whenever the motor 18 is driven, and the motor continues to be driven even when the compressed air requirements drop to a minimum. That is, even when there is little or no demand for compressed air, it is necessary for the motor to drive at least one other device 22 (e.g., a hydraulic pump) so the motor continues to run. The main air compressor 10 will thus continue to be driven and consume considerable energy in performing a much greater air compressing function than is needed. That occurs even if an air inlet valve 24 disposed at an air inlet 26 of the main air compressor is closed, because the compressor will continue to compress air at the air outlet 28. As noted earlier, the use of clutches, variable speed drives, etc. between the motor and the compressor could eliminate or reduce the unnecessary consumption of energy, but those mechanisms can result in substantially greater cost, complexity and/or maintenance concerns.

In accordance with the present invention, the energy consumed by the main air compressor can be considerably reduced by a relatively simple, inexpensive, and reliable mechanism even if the main compressor continues to be driven at full speed by the motor. In that regard, attention is directed to FIG. 3 which depicts an air compressing system according to a preferred embodiment of the invention. The components shown therein that correspond to the components of FIGS. 1 and 2 are referenced by the same numerals. It will thus be appreciated that the main screw compressor 10 of FIG. 3 corresponds to the compressor 10 of FIGS. 1 and 2 that is driven by the motor 18. The term "motor" as used herein means any suitable power plant, whether driven for example by fuel (e.g., an internal combustion engine, or a diesel engine) or driven electrically.

Figure 3:
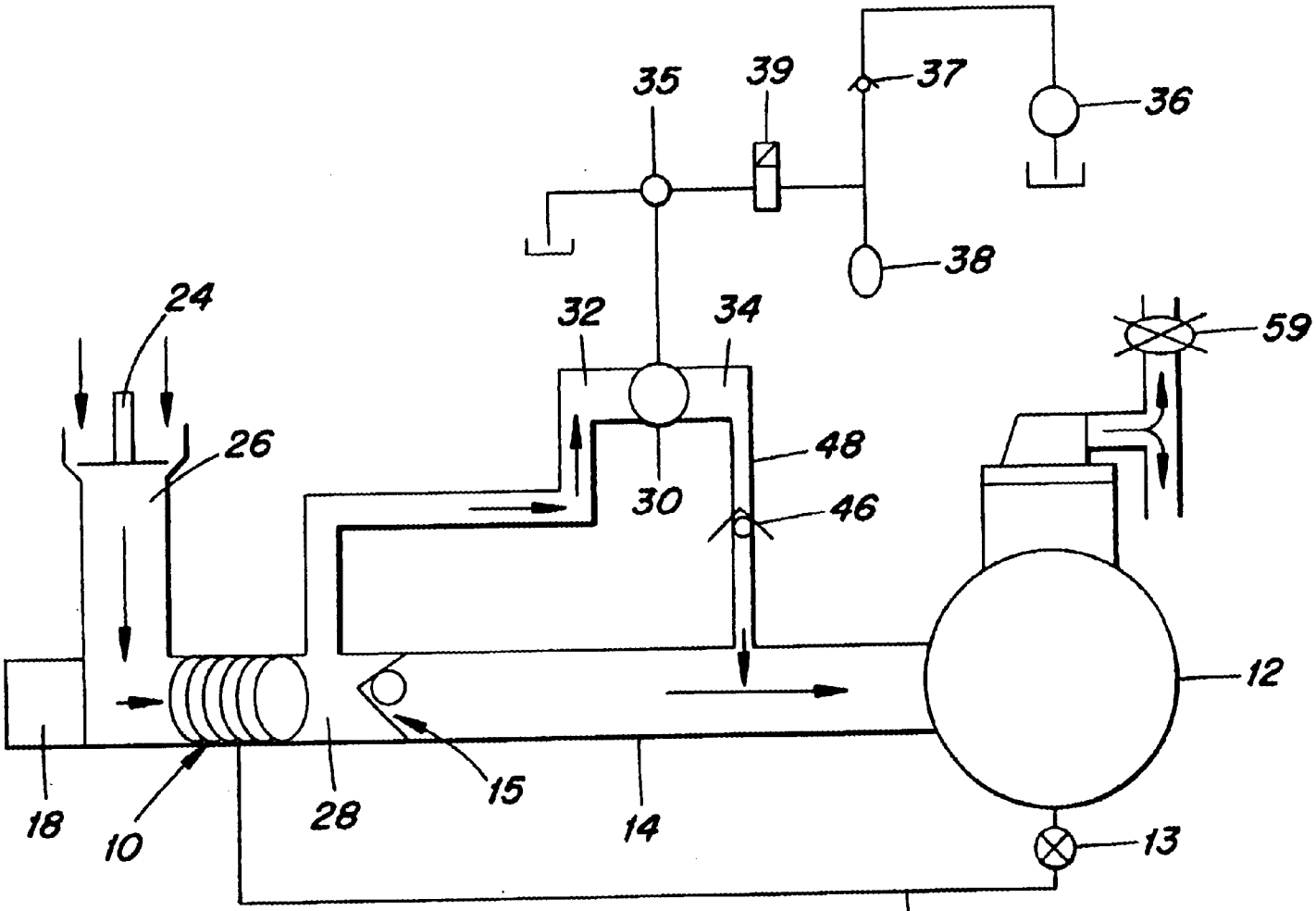
FIG. 3 is a schematic view of an air compressing system according to a first embodiment of the present invention.

Also provided is a small vacuum device 30 which has an air inlet 32 and an air outlet 34. The vacuum device can be any device which creates a vacuum, such as a vacuum pump, or a compressor (e.g., a small screw compressor). Any suitable drive mechanism is provided for driving the vacuum device, such as, for example, an electric motor having a belt drive and clutch, or as shown in FIG. 3, a hydraulic system comprised of a variable speed hydraulic motor 35 driven by a hydraulic pump 36. The hydraulic system shown in FIG. 3 also includes a non-return valve 37, a hydraulic accumulator 38, and a shut-off valve 39 for reasons to be discussed.

The vacuum device is preferably small, i.e., it has a substantially smaller capacity than the main air compressor 10 and thus requires much less energy to operate when compressing air. For example, a vacuum device (such as a small screw compressor) could have a maximum capacity less than ten percent (most preferably between three and seven percent) of the maximum capacity of the main screw compressor.

The air inlet 32 of the vacuum device 30 communicates with the air outlet 28 of the main screw compressor 10 at a location upstream of a non-return valve 15 (i.e., upstream with reference to the direction of air flow through the main air discharge passage 14).

A non-return valve 46 is disposed in a secondary air discharge passage 48 that extends from the air outlet 34 of the secondary vacuum device and connects to the main air discharge passage 14 at a location downstream of the non-return valve 15.

Figure 6:
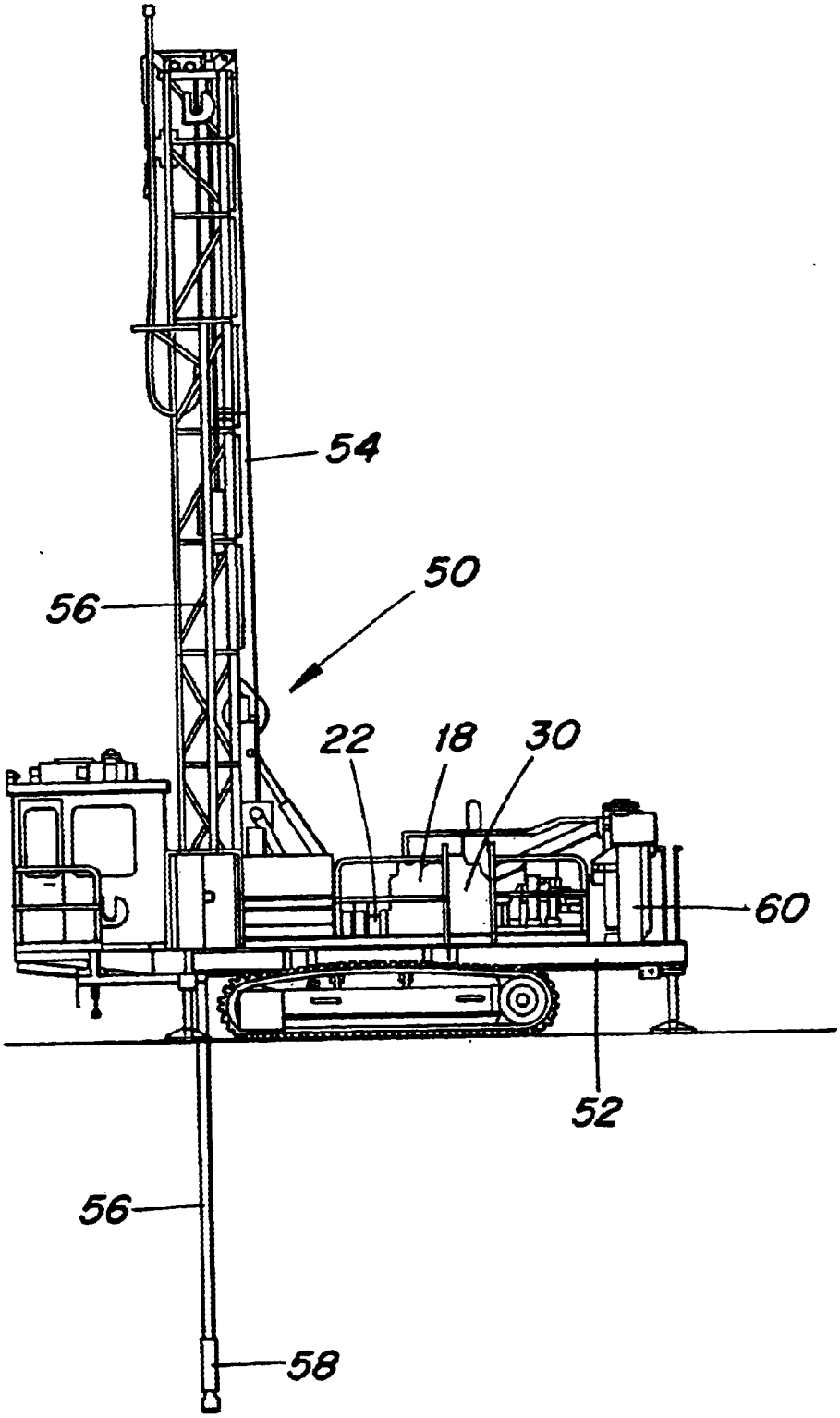
FIG. 6 (PRIOR ART)
FIG. 6 is a side elevational view of a conventional drilling apparatus for drilling holes in the ground and in which the present invention can be effectively utilized.

The operation of the system disclosed in connection with FIG. 3 will now be discussed, with the system used in a specific application, namely a mobile drilling rig 50 depicted in FIG. 6. It should be appreciated however, that the system can be utilized in many other applications as well. The drilling rig 50 includes a main frame 52 on which is mounted a mast 54 that can be raised or lowered. When raised, the mast supports drill rods 56 for forming a drill string which can be sequentially lowered into the ground during a drilling operation, the drilling performed by a drill bit 58 disposed at a lower end of the drill string. During a drilling operation, the drill bit is rotated by a hydraulic mechanism supplied with pressurized hydraulic fluid from hydraulic pumps 22 driven by the motor 18. Cuttings produced by the drill bit are carried to the surface by compressed flushing air that is delivered downwardly through the drill string and then conducted upwardly along the exterior of the drill string. The flushing air is supplied by the main screw compressor 10 that is driven by the motor 18. A flushing valve 59 is provided to control the flow of flushing air to the drill string. A water cooling system 60 is provided for cooling the hydraulic fluid, the cooling system including a water pump and fan driven by the motor 18.

When drilling in hard ground or rock, percussive drilling may be performed wherein a reciprocating piston is provided to apply downward impacts to the drill bit as the drill bit rotates. The piston can be disposed either above the ground, or below the ground, i.e. just above the drill bit. A piston disposed above the ground is typically driven by pressurized hydraulic liquid, but a piston located just above the drill bit (i.e., so-call down-the-hole drilling) is driven by the compressed flushing air which then travels to the drill bit. When drilling in softer ground, the drill bit is rotated without any accompanying piston impacts (i.e., so-called rotary drilling). It will thus be appreciated that greater air pressure is required during down-the-hole percussive drilling than during rotary drilling.

Drilling:

During a drilling operation (i.e., rotary or percussive drilling) the air intake valve 24 is open, and the main screw compressor 10 is driven at full speed by the motor 18, the vacuum device 30 being either driven or non-driven. Accordingly, the main screw compressor receives and compresses air from the air intake 24 and supplies it to the air reservoir 12. Compressed air is withdrawn from the air reservoir to perform various functions, primarily to serve as flushing air to flush and cool the drill bit and carry cuttings up to the surface, and possibly to also reciprocate a piston (if down-the-hole percussive drilling is being performed).

Unloading the Screw Compressor, During Motor Operation:

It will eventually be necessary to temporarily stop the drilling operation, e.g., when adding or removing drill rods, setting up the drill for drilling, relocating the drilling rig, etc., whereupon flushing air is not needed. Accordingly, the flushing valve 59 will be closed. The motor 18 continues to be driven in order to operate other equipment, e.g., the cooling system 60 and the hydraulic pumps that are raising or lowering the drill rods. The main screw compressor 10 continues to be driven due to the nature of its connection with the motor. Thus, even though the air pressure stored in the air reservoir 12 has reached a maximum required pressure, and the actual compressed air consumption is zero or minimal, the main screw compressor 10 will continue to be driven at high speed, thereby consuming energy unnecessarily. Some of that energy consumption can be reduced by closing the air intake valve 26, but a considerable amount of energy would still be consumed if the main screw compressor continued compressing air at the air outlet 28.

In accordance with the present invention, the main screw compressor 10 is unloaded, so as to cease compressing air at the air outlet 28. That is achieved by closing the air inlet valve 24, and driving the vacuum device 30. Hence, the air inlet 32 of the vacuum device is placed in communication with the air outlet 28 of the main screw compressor 10 to pull a vacuum at the air outlet 28 which closes the non-return valve 15 and sucks air out of the compressor so the compressor screw has no air, or very thin air, left to compress. Consequently, the density of air inside the main screw compressor is substantially reduced, and the suction and exhaust pressures at opposite sides of the main screw compressor are substantially equalized. That results in the compressor being unloaded, so that rotation thereof is made easier, to considerably reduce the energy necessary to operate the main screw compressor. Accordingly, the motor 18 can be operated at lower horsepower and reduced operating cost, accompanied by increased motor life and compressor life.

Importantly, the system is so designed that, despite unloading the main screw compressor, there is no interference or interruption of the lubrication of the main screw compressor 10. That is, the air reservoir can continue to supply lubricating/cooling oil to the main screw compressor, because the vacuum device 30 will return that oil to the air reservoir.

It will be appreciated that the vacuum device 30 could be driven during a drilling operation to function as a pressure booster to boost the pressure of the compressed air supplied to the air reservoir 12.

Unloading the Screw Compressor at Motor Start-Up:

An additional advantage of the present invention involves the ability to unload the main screw compressor 10 during start-up of the motor in order to make it easier to start the motor. Such an advantage would be highly useful when starting the motor 18 and the main screw compressor in very cold weather, especially in the case of fuel-powered engines and/or when starting an electric motor which consumes possibly five to six times more amps during start-up than when operating the main screw compressor during conditions of maximum air consumption. That results in the need for oversized power cables and breakers to handle the high electric current.

The unloading of the main screw compressor during (or just before) motor start-up is achieved by driving the vacuum device 30. A most preferred way of driving the vacuum device during motor start-up involves the use of a pre-pressurized accumulator 38 shown in FIG. 3. In that regard, the driving of the hydraulic pump 36 prior to motor shut-down will have served to not only supply hydraulic liquid to the hydraulic motor 35 but also to pressurize the hydraulic accumulator 38 which is in communication with the outlet of the pump 36. When the motor 18 was shut down, the shut-off valve 39 disposed between the hydraulic motor 35 and the accumulator 38 would have been closed, leaving the accumulator in a pressurized state. During, or just before, a subsequent start-up of the motor, the valve 39 is opened, allowing the pressurized hydraulic liquid from the accumulator to temporarily drive the motor 35 which, in turn, drives the vacuum device 30, e.g., for a few seconds, in order to create a vacuum in the main screw compressor and thereby minimize the power needed to rotate the screws of the main screw compressor. As a result, a smaller load is applied to the starting motor to facilitate its start-up. The air inlet 26 will, of course, be closed during the unloading of the compressor and the start-up of the engine.

Figure 4:
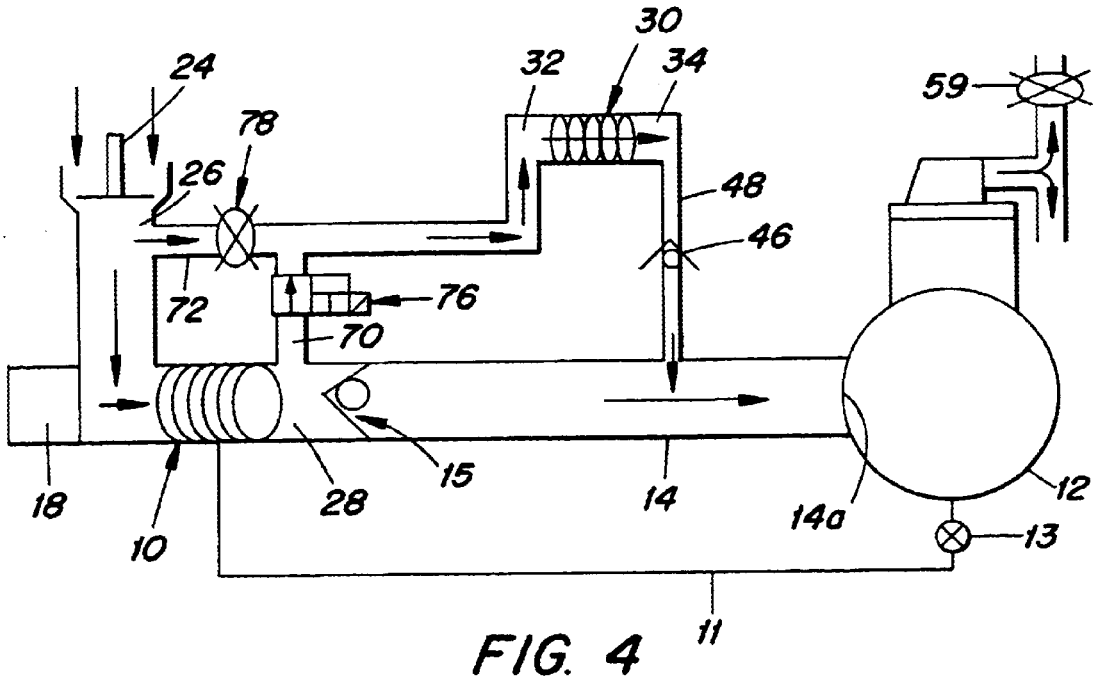
FIG. 4 is a schematic view of an air compressing system according to a second embodiment of the present invention.
Figure 5:
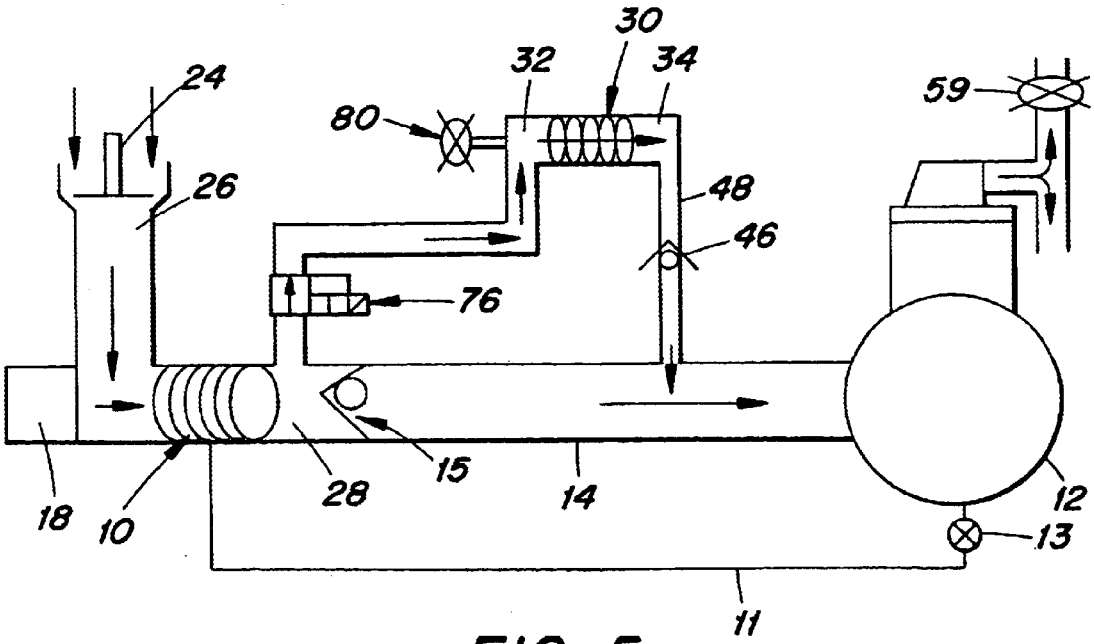
FIG. 5 is a schematic view of an air compressing system according to a third embodiment of the invention.

Modifications:

Two modified forms of the invention are depicted in FIGS. 4 and 5, respectively, each of which enables the vacuum device 30 to function selectively as a pressure booster and as an air volume booster. With reference to FIG. 4, a pair of passages 70 and 72 connect the air inlet side 32 of the vacuum device 30 respectively to the air outlet 28 and the air inlet 26 of the main screw compressor 10. A pair of shut-off valves 76, 78 are provided for selectively opening and closing the passages 70, 72, respectively. During a drilling operation, the valves 76 and 78 can be closed, whereby the main screw compressor 10 functions as the sole compressor of flushing air. For example, the system could be operated in that mode during rotary drilling (i.e., when no reciprocating impact piston is provided). If the system were instead used in a percussive drilling operation (wherein the flushing air reciprocates an impact piston), the valve 76 could be opened to communicate the air inlet 32 of the vacuum device with the air outlet 28 of the main screw compressor 10, whereupon the vacuum device would function as a pressure booster.

In the event that additional air volume is needed during a drilling operation, it is merely necessary to open the valve 78 to communicate the air inlet 32 of the vacuum device with the air inlet 26 of the main screw compressor 10. Then, the rpm of the vacuum device would be increased, e.g., by the use of a variable speed drive for the vacuum device to draw-in additional air.

It will be appreciated that during a compressor-unloading operation wherein the vacuum device unloads the main screw compressor 10, as described earlier, the valve 76 would be open, and the valve 78 could be either open or closed, because the respective pressures at the air inlet and air outlet of the main screw compressor 10 would be substantially equalized regardless of whether the valve 78 is open or closed.

It will be appreciated that the passage 72 and the valve 78 could be omitted from the system. Instead, the main function performed by the passage 72 and the valve 78, i.e., to provide additional air volume, could be performed by providing a valved air inlet 80 for the secondary screw compressor, as shown in the modification according to FIG. 5. A similar expedient could be provided in the embodiment disclosed in connection with FIG. 3.

Figure 7:
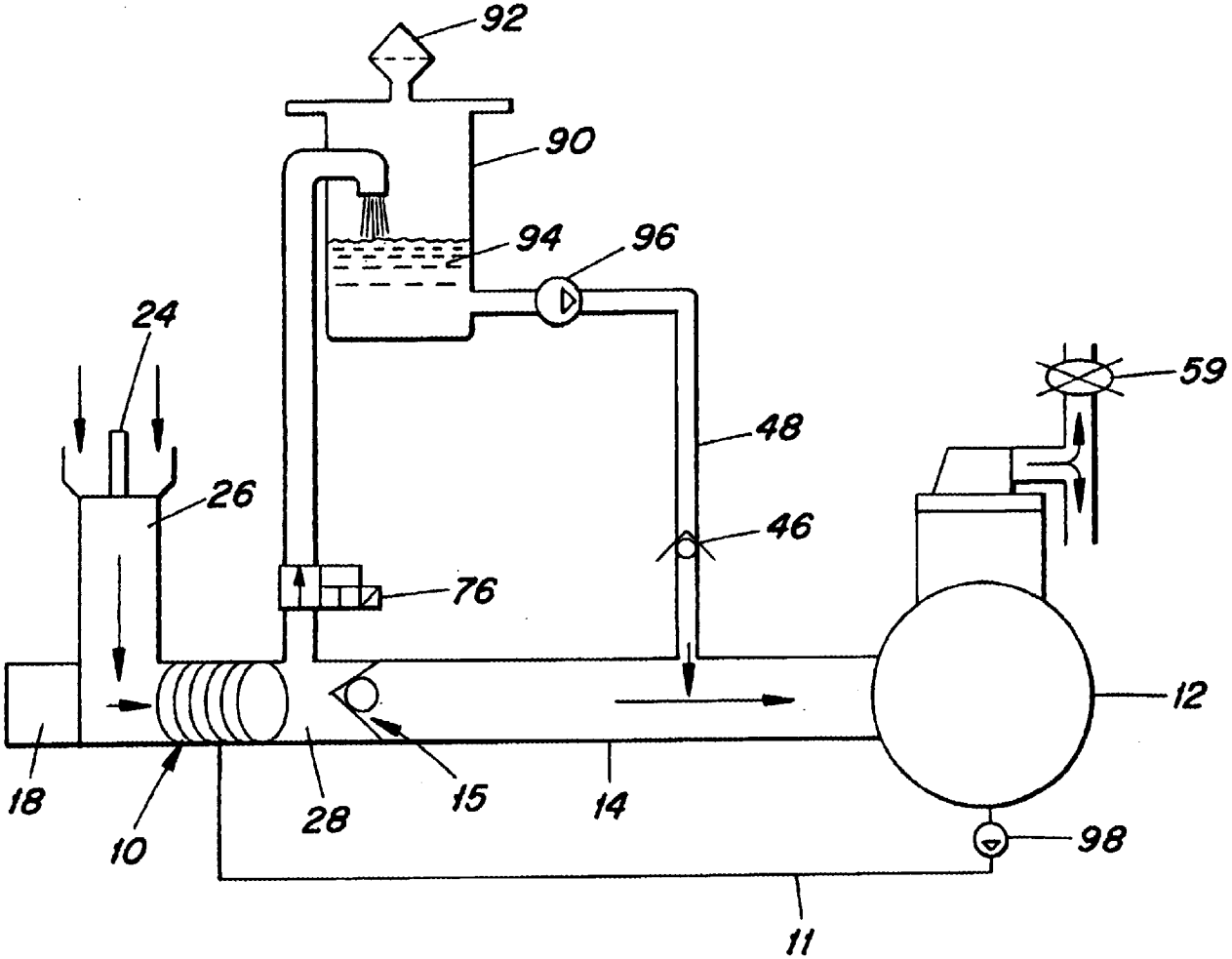
FIG. 7 is a schematic view of an air compressing system according to a fourth embodiment of the invention.

It will be appreciated that benefits are achieved by the removal of air from the main screw compressor during periods of low compressed air consumption, even if that removal is less than complete. In that regard, depicted in FIG. 7 is an unloading system which does not employ a vacuum device to suck air from the main screw compressor. Instead, a small tank 90 is provided to which lubrication oil can be blown by the main screw compressor when the inlet valve 24 is closed and the valve 76 is open, as shown in FIG. 7. The tank 90 is open to atmosphere by way of a conventional air breather 92. Oil 94 from the tank 90 is pumped to the air reservoir 12 by a hydraulic pump 96. That also causes the non-return valve 15 to close. The air reservoir 12 would also be open to atmosphere. A pump 98 would pump oil to the main screw compressor 10. As the main screw compressor blows out oil, it also blows out air, thereby reducing the air density within the main screw compressor, making it easier to rotate the screws. Ease of rotation also results from the fact that the main screw compressor acts only against atmospheric pressure, i.e., 14.5 psi, as it blows out the oil.

Although the compressor is not unloaded to the same extent as in the previously described embodiments wherein a vacuum is established in the main screw compressor, the compressor is nevertheless unloaded by an amount sufficient to considerably reduce the power required to operate it.

The activation of the various valves of the previously described embodiments could be performed manually, but is preferably performed automatically.

The air inlet valve 24 could, if desired, be provided with a small hole drilled therethrough to enable a small amount of air to pass through the valve 24 even when the valve closed, if needed to reduce compressor noise. However, the amount of air that would pass through such a hole is so small that, as defined herein, the air inlet would still be considered as "closed."

It will be appreciated that the present invention enables the power consumption of the motor to be appreciably reduced in a relatively simple and economic manner while continually driving the main screw compressor, or while starting-up the motor.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A screw compressor unloading system comprising:

a screw compressor including an air inlet and an air outlet, the air inlet having an air inlet intake valve for closing the air inlet;

a vacuum device of substantially smaller maximum capacity than the screw compressor, the vacuum device having an air inlet and an air outlet, the air inlet of the vacuum device being communicable with the air outlet of the screw compressor to enable the vacuum device to unload the screw compressor by sucking air out of the screw compressor when the air inlet intake valve is closed; and an air reservoir connected to the air outlet of the screw compressor, and a non-return valve arranged to prevent backflow of air from the air reservoir to the air outlet of the screw compressor;

the air outlet of the vacuum device being connected to supply compressed air to the air reservoir, such that the vacuum device constitutes a pressure booster.

2. The screw compressor unloading system according to claim 1 further including a conduit for conducting lubricating oil from the air reservoir to the screw compressor, the lubricating oil being returned to the air reservoir by the vacuum device.

3. The screw compressor unloading system according to claim 1 further including a valve arranged for opening and closing communication between the air inlet of the vacuum device and the air outlet of the screw compressor.

4. The screw compressor unloading system according to claim 1 further including a valve selectively operable and closable to communicate the air inlet of the vacuum device with a source of fresh air, wherein the vacuum device constitutes an air volume booster.

5. The screw compressor unloading system according to claim 1 further including a motor operably connected to the screw compressor for driving the screw compressor whenever the motor is running.

6. A screw compressor unloading system comprising:

a screw compressor including an air inlet and an air outlet, the air inlet having an air inlet intake valve for closing the air inlet;

a vacuum device of substantially smaller maximum capacity than the screw compressor, the vacuum device having an air inlet and an air outlet, the air inlet of the vacuum device being communicable with the air outlet of the screw compressor to enable the vacuum device to unload the screw compressor by sucking air out of the screw compressor when the air inlet intake valve is closed; and further including a main air discharge passage connected to the air outlet of the screw compressor, a non-return valve disposed in the main air discharge passage, and a secondary air discharge passage communicating the air outlet of the vacuum device with the main air discharge passage at a location downstream of the non-return valve.

7. The screw compressor unloading system according to claim 6 further including a non-return valve in the secondary air discharge passage.

8. A screw compressor unloading system comprising:

a screw compressor including an air inlet and an air outlet, the air inlet having an air inlet intake valve for closing the air inlet;

a vacuum device of substantially smaller maximum capacity than the screw compressor, the vacuum device having an air inlet and an air outlet, the air inlet of the vacuum device being communicable with the air outlet of the screw compressor to enable the vacuum device to unload the screw compressor by sucking air out of the screw compressor when the air inlet intake valve is closed; and wherein the vacuum device comprises a screw compressor.

9. A screw compressor unloading system comprising:

a motor;

a screw compressor operably connected to the motor for being driven thereby whenever the motor is running, the screw compressor including an air inlet and an air outlet, the air inlet having an inlet valve for closing the air inlet;

an air reservoir;

a main air discharge passage connecting the air outlet of the screw compressor with the air reservoir and including a first non-return valve preventing backflow of compressed air to the air outlet of the screw compressor;

a conduit for conducting lubricating oil from the air reservoir to the screw compressor;

a vacuum device of substantially smaller maximum capacity than the screw compressor and having an air inlet and an air outlet; and a secondary air discharge passage communicating the air outlet of the vacuum device with the main air discharge passage at a location downstream of the first non-return valve, the secondary air discharge passage having a second non-return valve for preventing a backflow of compressed air to the air outlet of the vacuum device;

the air inlet of the vacuum device communicating with the air outlet of the screw compressor to enable the vacuum device to unload the screw compressor by sucking air out of the screw compressor when the inlet valve is closed.

10. The screw compressor unloading system according to claim 9 further including a hydraulic motor for driving the vacuum device, a hydraulic pump for supplying pressurized hydraulic liquid to the hydraulic motor, an accumulator communicating with the pump for storing pressurized hydraulic liquid, and a valve for selectively opening and closing communication between the accumulator and the hydraulic motor to enable pressurized hydraulic liquid from the accumulator to temporarily drive the hydraulic motor and the vacuum device.

11. A method of unloading a screw compressor comprising the steps of:

A) driving the screw compressor with an air inlet thereof closed;

B) sucking air out of the screw compressor by a suction device communicating with an air outlet of the screw compressor to substantially unload the screw compressor; and C) supplying compressed air from the air outlet of a vacuum device to an air reservoir and supplying lubricating oil to the screw compressor from the air reservoir, the lubricating oil conducted back to the air reservoir by the vacuum device along with air sucked out of the screw compressor by the vacuum device.

12. A method of unloading a screw compressor to facilitate start-up of a drive motor therefor, comprising the steps of:

A) closing an air inlet of the screw-compressor;

B) driving a vacuum device having a substantially smaller maximum capacity than the screw compressor;

C) communicating an air inlet of the vacuum device with an air outlet of the screw compressor, causing the vacuum device to unload the screw compressor by sucking air out of the screw compressor;

D) starting the drive motor to drive the screw compressor; and

E) supplying compressed air from an air outlet of the vacuum device to an air reservoir and supplying lubricating oil to the screw compressor from the air reservoir, the lubricating oil conducted back to the air reservoir by the vacuum device.

* * * * *